US005165806A

United States Patent [19]

Collins

[11] Patent Number: 5,165,806

[45] Date of Patent: Nov. 24, 1992

[54] THERMAL PRINTER WITH MOVABLE DRIVE ROLL

[75] Inventor: Ian P. Collins, Houghton, United Kingdom

[73] Assignee: Esselte Dymo N.V., Niklaas, Belgium

[21] Appl. No.: 794,500

[22] Filed: Nov. 20, 1991

[30] Foreign Application Priority Data

Nov. 20, 1990 [GB] United Kingdom ..... 9025242

[51] Int. Cl.[5] ..... B47J 3/02; B47J 35/28

[52] U.S. Cl. ..... 400/120; 400/208; 400/223

[58] Field of Search ..... 400/120, 196, 208, 223; 346/76 PH

[56] References Cited

U.S. PATENT DOCUMENTS

| | | | |
|---|---|---|---|
| 4,815,875 | 3/1989 | Richardson et al. | 400/208.1 |
| 4,848,941 | 7/1989 | Imaseki | 400/120 |
| 4,966,476 | 10/1990 | Kuzuya et al. | 400/120 |
| 5,022,771 | 6/1991 | Paque | 400/120 |
| 5,049,228 | 9/1991 | Sato | 400/208 |
| 5,056,940 | 10/1991 | Basile | 400/120 |

FOREIGN PATENT DOCUMENTS

| | | |
|---|---|---|
| 0322919A2 | 5/1989 | Japan . |
| 2-63881 | 3/1990 | Japan . |
| 216279A | 2/1986 | United Kingdom . |
| 2234469A | 2/1991 | United Kingdom . |

*Primary Examiner*—Eugene H. Eickholt
*Attorney, Agent, or Firm*—Pennie & Edmonds

[57] ABSTRACT

A printer comprises a cassette bay (8) having a lid (16), a printing mechanism comprising a thermal print head (26) and a platen (32) and a mechanism (38, 50) for moving the theremal print head between an inoperative and an operative position. The mechanism is also responsible for simultaneously moving a drive roller of the printer between an inoperative and operative position. In the operative position, the drive roller cooperates with an output roller of a cassette inserted into the printer to provide an outlet nip.

8 Claims, 5 Drawing Sheets

FIG.6.
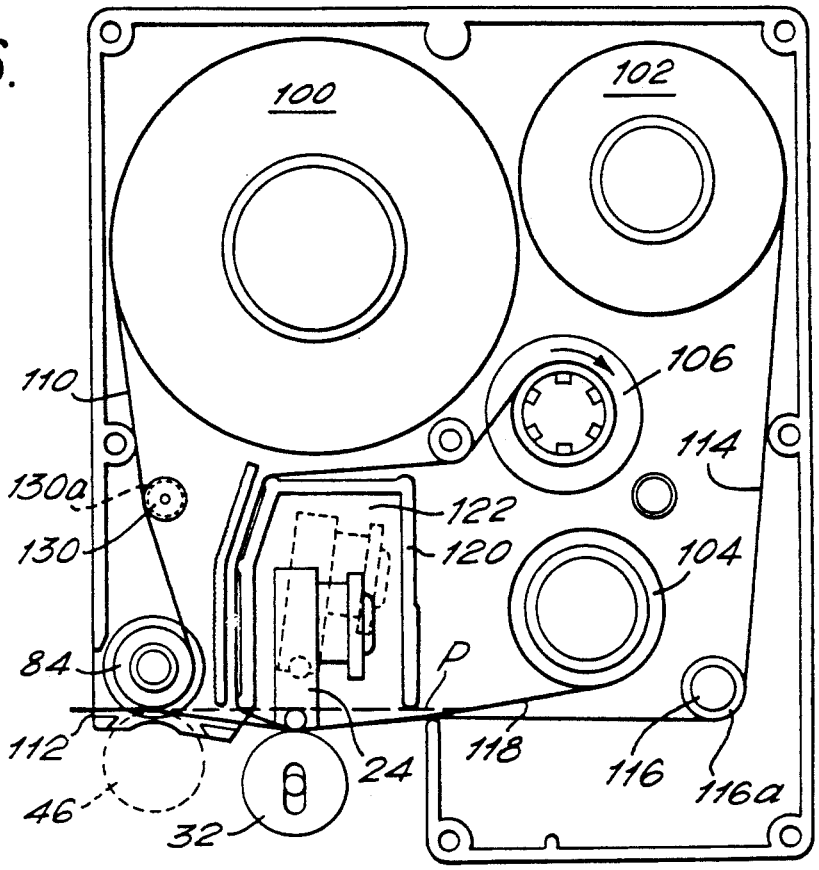
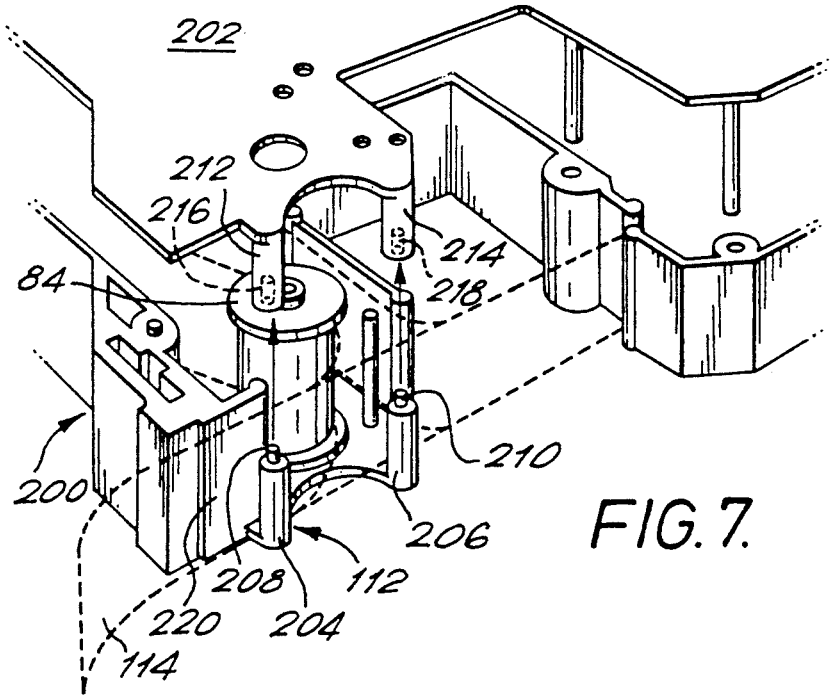
FIG.7.

THERMAL PRINTER WITH MOVABLE DRIVE ROLL

This invention relates to a thermal printer.

A thermal printer is one in which printing is carried out using an electrically activated print head with a plurality of individually energisable heating elements which, when brought into contact with an ink ribbon and heated, transfer the ink from the ribbon to an image receiving tape in accordance with the data to be printed. A cassette carrying the ink ribbon and the image receiving tape is loaded into the printer so that the ink ribbon and image receiving tape are guided in overlap through a printing zone. During printing, the image receiving tape is held against the ink ribbon by a platen bearing against the print head and holding the ink ribbon and image receiving tape under pressure therebetween.

A thermal printer of this type is described in European Patent Application Publication No. 0322919 in the name of Brother.

In this thermal printer, the printing zone is defined by a print head which is fixedly mounted in the printer and a platen which is moveable between a printing state in which the platen bears against the print head and an inoperative state in which the platen is spaced from the print head to define a gap to enable a cassette to be inserted with the image receiving tape and ink ribbon in overlap in the gap. The platen is mounted on a holder member which can be moved by a lever between the two states. The cassette for the thermal printer houses, in addition to the ink ribbon and image receiving tape, a spool carrying an adhesive backing layer which is applied to the printed surface of the image receiving tape after it has been printed and before it is fed out of the printer. This is accomplished by cooperation of a feed roller of the cassette and a drive roller mounted on the holder member. When the holder member is moved to bring the platen into its printing state the drive roller is brought into contact with the feed roller to form a nip to drive the printed tape from the printer which applies the adhesive backing layer.

A complication which arises in use of the known thermal printer affects the construction of the cassette. Printing is carried out in mirror image on one side of a transparent image receiving tape so that when viewed from the other side of the tape it appears to be the correct way round. The printed text can be viewed the correct way round as it emerges from the printer through the surface of the image receiving tape facing the user. To achieve this, the ink ribbon is housed within the cassette on the inner (printing) side of the image receiving tape. As the print head is fixed, this creates a difficulty on insertion of the cassette since the ink tape must be placed to lie between the print head and the image receiving tape and yet must not foul on the print head during insertion. To overcome this, the known cassette incorporates a biasing arrangment which holds the ink ribbon away from the print head on insertion.

It is an object of the present invention to provide a thermal printer which enables a cassette to be used therein to have a simpler construction.

According to the present invention there is provided a thermal printer having a thermal print head movable between an operative and an inoperative position, a platen fixed relative to the printer to define with the thermal print head a print zone; and a drive roller which is mounted to be movable between an inoperative and an operative position, which drive roller in the operative position thereof cooperates with an output roller of a cassette inserted into the printer to provide an outlet nip wherein the drive roller and thermal print head are mounted on a common mechanism so that they are moved simultaneously into their operative positions when the mechanism is actuated.

Reference is made to our copending Application No. 07/795,325 which describes actuation of the mechanism in response to opening and closing a lid of the printer.

The output roller and drive roller serve to drive tape housed by the cassette out of the printer after the tape has been printed. In cases where the printer can receive cassettes which include not only image receiving tape and ink ribbon but also a spool of an adhesive backing layer, the output roller of the cassette cooperates with the drive roller on the printer to apply the adhesive backing layer to the printed tape. Thus, the output roller and drive roller can perform a laminating function in addition to driving tape through the outlet of the printer. The drive roller can be driven by a drive system of the printer.

As the print head is moved into its inoperative position to enable a cassette to be removed, the image receiving tape, which had been under pressure between the platen and the print head moves away under its own resilience and adopts a path through the printing zone which maintains the ink ribbon out of contact with the platen and the thermal print head.

This removes the need for biasing means or other constructional features in the cassette designed to keep the ink ribbon out of contact with the platen and thermal print head when the cassette is to be replaced. Construction of the cassette is thus simpler and cheaper.

With the present invention the drive roller and the output roller are brought into contact with each other simultaneously with the print head being brought into contact with the platen. It will be appreciated that, when considering the path of the ink ribbon and tape through the printing zone, the requirement on actuating the mechanism is to move the print head away from that path to one side of it and the drive roller away from that path to the other side of it, in a "scissor-type" action.

In the described embodiment the common mechanism includes a cam coupled to a lid of the printer, the cam surface being in contact with one end of an actuation lever the other end of which is pivotably mounted to a bracket supporting the print head. As the point of contact of the cam surface with the actuation arm is altered in response to opening or closing of the lid, the bracket is pivoted into or out of the operative position respectively. The drive roller is mounted to a carriage which is pivotably mounted relative to the printer and has an arm which is coupled to the bracket which supports the thermal print head and is connected to through biasing means in such a manner that on pivoting of the said bracket the carriage is caused to pivot to bring the drive roller into contact with the output roller. This arrangement provides the "scissor-type" action in a reliable manner.

The drive system of the printer can comprise a gear wheel, for driving the output roller of a cassette, adapted to mesh with a gear wheel fixedly mounted to the drive roller. The drive roller gear wheel can be arranged to be brought into and out of mesh with the gear wheel of the drive system in response to movement of the lid.

Preferably a further biasing means, such as a tension spring, is connected between the actuation arm and the printer in such a position relative to the hinge line of the lid with a cassette receiving portion of the printer that, with the lid in the closed position, the action of the further biasing means on the actuation arm against the action of the cam serves to maintain the lid in that position with the print head in the operative position and, with the lid in the open position, the torque provided by the further biasing means maintains the lid in the open position with the print head in the inoperative position.

Reference is made to our copending Application No. 69561 which describes a control system for operating the printer.

For a better understanding of the present invention, and to show how the same may be carried into effect, reference will now be made, by way of example, to the accompanying drawings, in which:

FIG. 6 is a plan view of a cassette for insertion into the thermal printer;

FIG. 7 is a perspective view of part of the cassette housing; and

Figure 8A:
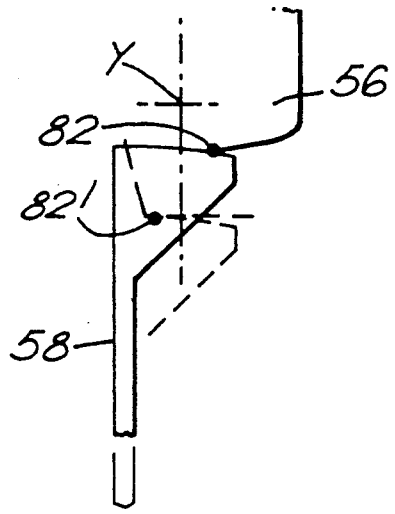
Figure 8B:
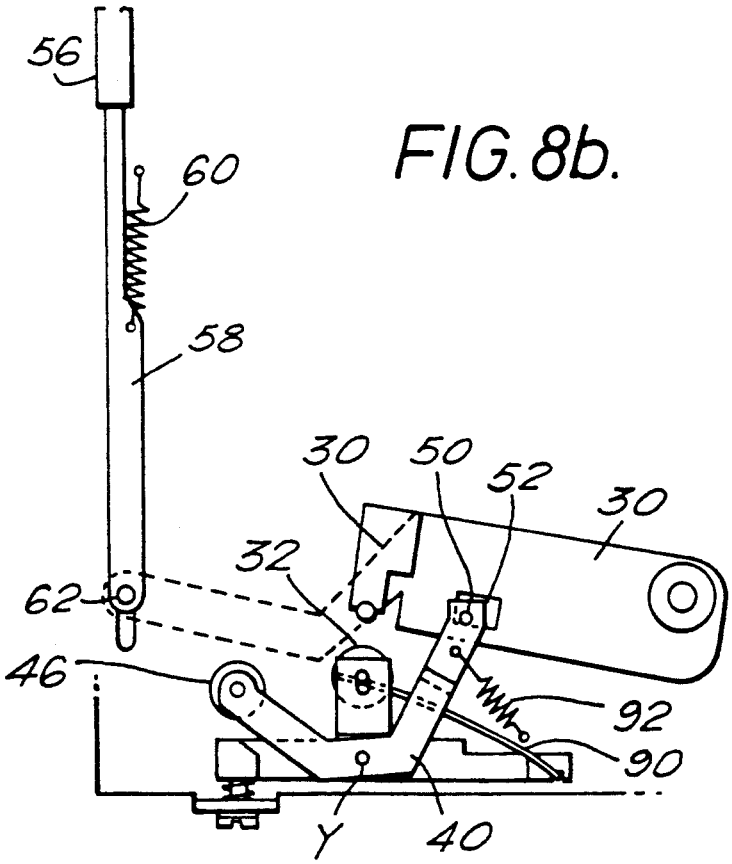

FIGS. 8*a* and 8*b* illustrate the operation of the linkage between the lid and the printing mechanism.

Figure 1:
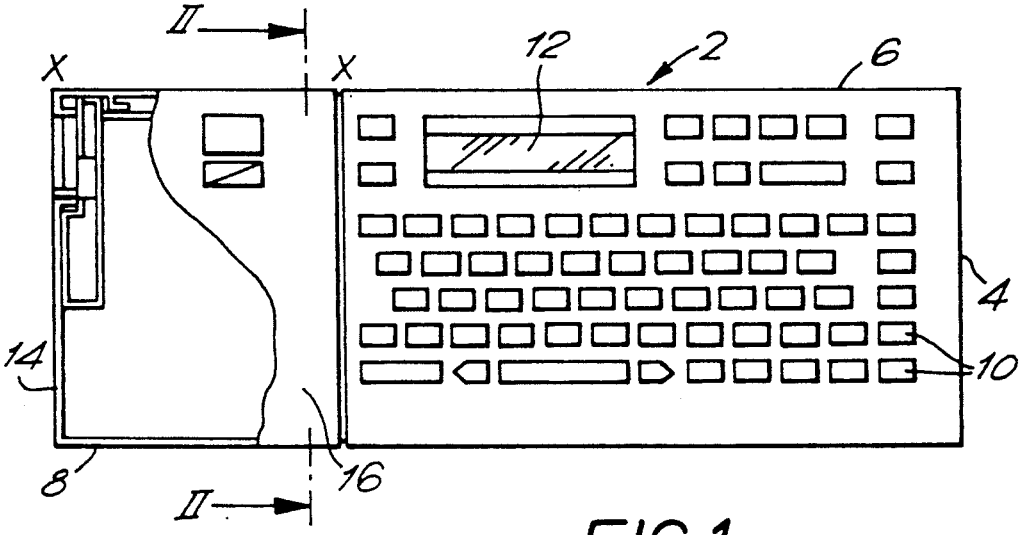
FIG. 1 is a plan view of a thermal printer.

FIG. 1 is a plan view of a thermal printer 2 comprising a casing 4 which has a right hand part 6 housing electronic circuitry for controlling operation of the printer and a left hand part acting as a cassette bay 8 and housing a printing mechanism. The right hand part 6 carries keys 10 for entering print data into the thermal printer and a display screen 12 for displaying the entered print data prior to printing. The cassette bay 8 comprises a casing base 14 and a lid 16. The lid 16 is shown cut away in FIG. 1 to reveal details of part of the printing mechanism which will be described in more detail hereinafter.

Figure 2:
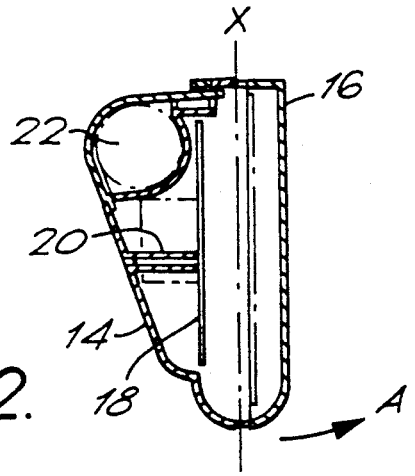
FIG. 2 is a section along line II—II in FIG. 1.

Referring now to FIG. 2, it can be seen that the lid 16 is hingedly connected to the casing base 14 along hinge line x—x. The lid opens in the direction of arrow A to reveal a chassis 18 for receiving a cassette for the thermal printer 2. The chassis 18 is supported on the base 14 by a chassis mounting boss 20 and extends forwardly at an angle relative to the base 14. In FIG. 2, reference numeral 22 designates a battery for the printer 2.

Figure 3:
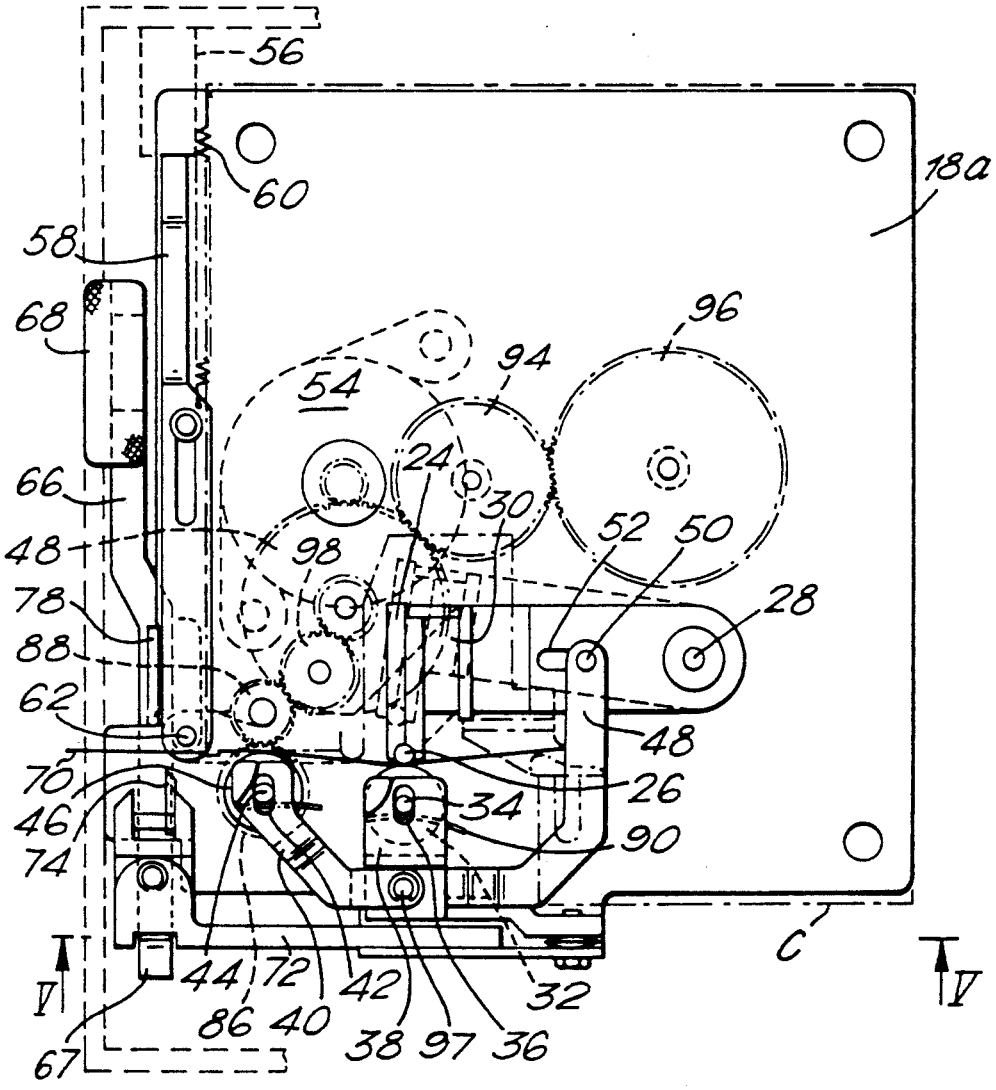
FIG. 3 is a plan view of the cassette receiving portion of the printer with the lid having been removed.

FIG. 3 is a plan view of the printing mechanism, shown looking down on the cassette bay 8 of FIG. 1 with the lid 16 having been removed. The printing mechanism comprises a thermal print head 24 which can for example be of the type comprising an elongate glass rod 26 (extending into the plane of the paper in FIG. 3) carrying a row of thermally activatable heating elements. This type of thermal head is known and can be obtained from SUSUMU CO. LTD., PART NO. TE5-GA006401-0114. It will be apparent that other types of print head can be used with the present invention. There is formed below the cassette chassis 18 a pressed steel baseplate 18*a*. To this baseplate is mounted a linkage mechanism actuating the thermal print head 24 and a drive roller 46. The print head 24 is secured to a print head support bracket 30 which pivots about a pin 28 secured to the baseplate 18*a* between an operative position, shown in FIG. 3, and an inoperative position shown in broken lines in FIG. 3. In the operative position the glass rod 26 of the print head 24 bears against a platen 32 which is spring loaded towards the thermal print head 24 by a spring 90. The spring 90 gives the correct contact pressure of the platen against the print head, as specified by the manufacturer of the print head. When a cassette is loaded in the cassette chassis 18, printing tape 70 passes between the print head 24 and platen 32 as will be described more particularly hereinafter. The platen 32 is rotatably mounted on a pin 34 secured to the baseplate 18*a* the upper end of which pin is guided in a slot 36 of a first roller cage 38. A second roller cage moulding 40 is pivotably mounted at a pivot point 97 adjacent the first roller cage 38. The second cage moulding 40 has upper and lower slots, the upper one of which is designated 42, in which is guided a pin 44 which can move backwards and forwards within those slots. The drive roller 46 is secured to the pin 44 and rotates therewith. There is also secured to the pin 44 a gear wheel 86 by means of which the drive roller 46 is driven by a gear train to be described. The other end of the second roller cage moulding 40 has a pin 50 guided in a slot 52 of the print head support bracket 30.

The second roller cage moulding is connected by a tension spring 92 (shown in FIG. 8*b*) to the baseplate 18*a*.

Figure 5:
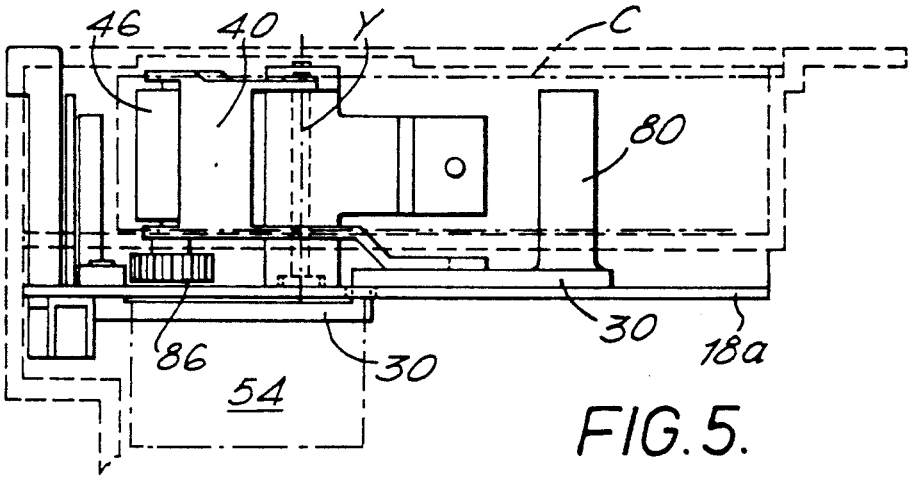
FIG. 5 is a view taken from the front of FIG. 3.

The print head support bracket 30 doglegs through the baseplate 18*a* (as can be seen in FIG. 5) and is pivotably connected via a pin 62 to an actuation arm 58 of the linkage mechanism.

Figure 4:
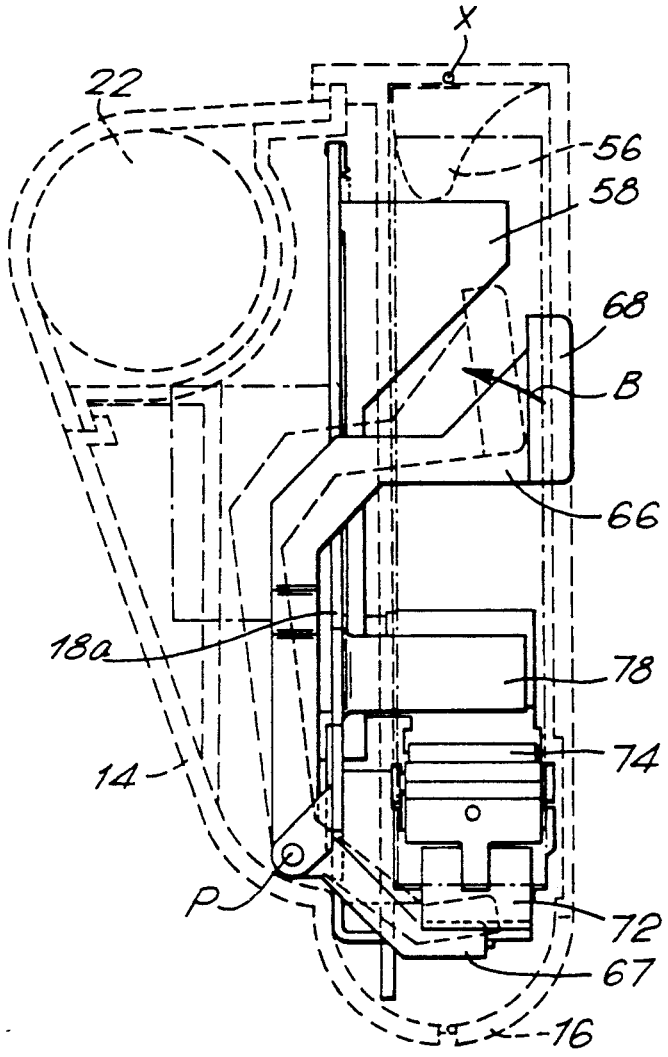
FIG. 4 is a view taken from the side of FIG. 3.

Reference will now be made to FIGS. 3 to 5 to describe the linkage mechanism operable to move the print head 24 and drive roller 46 when the lid 16 is open and closed. The lid 16 carries a cam 56 which bears against the print head actuation arm 58. The contact point of the cam 56 with the print head actuation arm is shown in the position with the lid closed in FIG. 4. The print head actuation arm 58 can slide relative to the baseplate 18*a* in response to the movement of the cam 56 when the lid is opened or closed. In the closed position the print head actuation arm 58 is biased towards the cam 56 by the action of a spring 60 The action of this spring 60 will be described in more detail hereinafter, with the operation of the linkage mechanism.

FIG. 4 also illustrates a cutting mechanism for the printer 2. The cutting mechanism comprises a cutting arm 66 carrying on one end a button 68 to be depressed by a user when the tape 70 is to be cut. The cutting arm 66 is pivotably monted at a pivot point p so that when the button 68 is depressed in the direction of arrow B the other end 67 of the cutting arm is brought into contact with a cutter support 72 which carries a cutting blade 74. The blade 74 acts against the cassette which is held in place by a turned up region 78 of the edge of the baseplate.

FIG. 5 shows the interconnection between certain elements of the printing mechanism more clearly. The feed roller 46 can be seen to be rotatably mounted in the second roller cage moulding with the gear wheel 86 mounted below it. FIG. 5 also shows that the pin 28 extends upwardly to lend rigidity to the pivoting components and serves as a support for a spool of a cassette inserted into the printer 2. The outline of a cassette is shown by a broken line designated C in FIGS. 3 and 5.

The drive system and gear train for the printer will now be described. A motor 54 is located beneath the baseplate and drives a double spur gear 48. The larger diameter spur gear drives, via an intermediate gear 94, a gear 96 which drives a ribbon rewind spool of a cassette inserted into the printer. The smaller diameter spur of the double spur gear 48 drives a gear 98 which drives a gear 88 which is mounted on the same pin as an output roller of the cassette The output roller acts with the drive roller 46 in its operative position to form a nip which applies an adhesive backing layer to the printed tape and causes the tape to be driven out of the printer. The gear 88 meshes with the gear 86 of the drive roller 46 when the latter is in the operative position.

FIG. 6 shows a plan view of a cassette loaded in the cassette bay 8, with the lid of the cassette removed. The cassette comprises a spool 100 of an adhesive backing tape 110, a spool 102 which supplies a transparent image receiving tape 114, an ink ribbon supply spool 104, an ink ribbon rewind spool 106 and an output roller 84. The backing tape 110 extends from the backing tape spool 100 around the output roller 84 and from there to the outlet 112 of the cassette. The image receiving tape 114 extends from its spool 102, around a guide 116, between the print head 24 and the platen 32, between the output roller 84 and drive roller 46 and to the outlet of the cassette.

The path of the backing tape is such that a guide 130 is needed. The backing tape has an adhesive layer on its outer surface with a releasable backing layer secured thereto and an adhesive layer on its inner side (facing the guide 130). To avoid adhesion of the tape to the guide 130, and consequent disruption to operation, the guide 130 has a plurality of circumferential notches or grooves 130*a* to reduce the area of the guide in contact with the tape.

The ink ribbon 118 runs from the supply spool 104, through a printing zone 122 between the print head 24 and the platen 32, round a guide 120 in the cassette which defines a recess delineating the printing zone 122 and finally to the ink ribbon to take up spool 106. The recess in the cassette accommodates the thermal print head and is large enough to accommodate movement of the print head into and out of the operative position.

In use an image is printed onto the surface of the image receiving tape facing the ink ribbon as a mirror image so that when viewed towards the other surface of the image receiving tape it is viewed the correct way round.

The ink receiving tape is made of transparent polyester about 50 μm thick. The span of the ink ribbon 118 between the supply spool 104 and the output roller 108, and the resilience of the image receiving tape 114 is such that, when the lid 16 is opened and the print head 24 returns to its inoperative position, the tape 114 returns under its own resilience to adopt a path (indicated by a broken line marked p in FIG. 6) out of contact with both the print head 24 and the platen 32. As the ink ribbon 118 lies behind image ink receiving tape, it is carried with the image receiving tape 114 to adopt the path P. In this way the ink ribbon is maintained out of contact with the print head and platen when the print head is in the inoperative position without the need for a biasing mechanism in the cassette to accomplish this objective.

FIG. 7 illustrates part of the cassette housing in a perspective view. The housing comprises a base part 200 and a closure member or lid 202. The base part 200 has two lower guide posts 204,206 each carrying a respective peg 208,210. The lid of the cassette 202 has two cooperating upper guide posts 212,214 which have central passages 216,218 for receiving respectively the pegs 208,210. The posts 206,214 define an enclosed guide through which the image receiving tape is passed. The posts 204,212 define a second guide through which image receiving tape and the adhesive backing layer are guided. On assembly of the cassette, the lower guide posts 204,206 define with wall regions 220,221 of the cassette housing slots to hold the ends of the tapes in place at the outlet 112. The lid 202 is then put in place so that the upper and lower guide posts mate to form enclosed guides for the tape.

It is a feature of the thermal printer 2 described herein that, as the lid 16 is opened, the thermal print head 24 is moved automatically from the operative position to the inoperative position. The manner in which this is achieved will now be described with reference to FIGS. 8*a* and 8*b*, which are schematic diagrams showing only those elements forming part of the linkage mechanism which achieves this result. The elements themselves have been described above with reference to FIGS. 3 to 5. The linkage mechanism has two important functions.

Firstly, when the lid is in the open position, the cam 56 contacts the actuation arm 58 at a contact point 82 which lies above the hinge line x—x. In this disposition the tension spring 60 exerts an anticlockwise torque about the hinge line and serves to keep the lid 16 in the open position. In contrast, when the lid 16 is in the closed position, the point of contact 82' between the cam 56 and the actuating arm 58 is now below the hinge line x—x so that the spring 60 exerts a clockwise torque about the hinge, against the action of the cam against the actuation arm serving to keep the lid closed. In FIG. 6*a*, the full line denotes the open position of the lid 16 and the dotted line denotes the closed position.

This arrangement of cam and spring ensures that the lid 16 is always maintained in the required position (open or closed) by positive spring action. There is therefore no need for a user to have to hold the lid open during insertion of a cassette or to worry about the lid 16 inadvertently opening during operation of the printer.

Secondly, the drive roller 46 and print head 24 are brought into and out of the operative positions automatically in response to closing and opening the cassette The position with the lid open is shown in FIG. 8*b*. The drive roller and print head are moved simultaneously in a "scissor-type" action by the linkage.

When the lid 16 is closed, the action of the cam 56 causes the actuation arm 58 to move forwardly (downwardly in FIG. 8*b*) bringing with it the print head support bracket 30 which pivots about the pin 62. The print head 24 is thus brought into contact with the tape 70 (not shown in FIG. 8*b*) and presses the tape 70 against the platen 32. As the print head support bracket 30 pivots about the pin 28, the spring 92 will cause the moulding 40 to move clockwise because the slot 52 moves to the right in FIG. 8*b*. The roller cage moulding 40 therefore rocks about pivot point y to cause the driver roller 46 to move upwardly in FIG. 8*b* bringing it into contact with the output roller 84 of the cassette and bringing its gear wheel 88 in the gear train of the printing mechanism The slot 52 is oversized so that as the drive roller 46 contacts the output roller 84, the pin 50 will drift. The bracket 30 continues to move without now moving the cage moulding 40. The drive roller 46 is held against the output roller 84 by the spring 92. On opening the lid, the motions are reversed to bring the print head 24 and roller 46 into their inoperative positions.

I claim:

1. A thermal printer adapted to cooperate with a cassette housing printing medium for receiving a printed image and having a thermal print head movable between an operative and an inoperative position, a platen fixed relative to the printer to define with the thermal print head a print zone; and a drive roller which is mounted to be movable between an inoperative and an operative position, which drive roller in the operative position thereof cooperates with an output roller of a cassette inserted into the printer to provide an outlet nip for said printing medium wherein the drive roller and thermal print head are mounted on a common mechanism so that they are moved simultaneously into their operative positions when the mechanism is actuated.

2. A printer as claimed in claim 1, in which the common mechanism includes a cam coupled to a control member, the cam having a surface being in contact with one end of an actuation lever the other end of which is pivotably mounted to a bracket supporting the print head, the arrangement being such that as the point of contact of the cam surface with the actuation lever is altered the bracket is pivoted into or out of the operative position respectively.

3. A printer as claimed in claim 2, wherein the control member is a lid of the printer.

4. A printer as claimed in claim 2 or 3, wherein the drive roller is mounted to a carriage which is pivotably mounted relative to the printer and has an arm which is coupled to the bracket which supports the thermal print head and is connected to the printer through biasing means in such a manner that on pivoting of the bracket the carriage is caused to pivot to bring the drive roller into its operative position into contact with the output roller.

5. A printer as claimed in claim 3, wherein the printer defines a cassette-receiving bay for receiving a cassette and wherein said lid is hingedly connected to said cassette-receiving bay along a hinge line.

6. A printer as claimed in claim 5, wherein a further biasing means is connected between the actuation arm and the printer in such a position relative to the hinge line of the lid with the cassette receiving bay of the printer that, with the lid in the closed position, the action of the further biasing means on the actuation lever against the action of the cam serves to maintain the lid in that position with the print head in the operative position.

7. A printer as claimed in claim 6, wherein with the lid in the open position the torque provided by the further biasing means maintains the lid in the open position with the print head in the inoperative position.

8. A thermal printer in cooperation with a cassette housing printing medium for receiving a printed image, the thermal printer having a thermal print head movable between an operative and an inoperative position, a platen fixed relative to the printer to define with the thermal print head a print zone; and a drive roller which is mounted to be movable between an inoperative and an operative position, the cassette having an output roller which cooperates with the drive roller in the operative position thereof to provide an outlet nip for said printing medium wherein the drive roller and thermal print head are mounted on a common mechanism so that they are moved simultaneously into their operative positions when the mechanism is actuated.

* * * * *